US006848399B2

(12) United States Patent
Watkins et al.

(10) Patent No.: US 6,848,399 B2
(45) Date of Patent: Feb. 1, 2005

(54) SCAVENGING INSERT FOR AN ENGINE

(75) Inventors: Paul D. Watkins, Texarkana, TX (US); Paul A. Warfel, Texarkana, TX (US); Scott W. Ericson, Texarkana, TX (US)

(73) Assignee: Electrolux Home Products, Inc., Cleveland, OH (US)

( * ) Notice: Subject to any disclaimer, the term of this patent is extended or adjusted under 35 U.S.C. 154(b) by 0 days.

(21) Appl. No.: 10/449,152

(22) Filed: May 30, 2003

(65) Prior Publication Data

US 2004/0237914 A1 Dec. 2, 2004

(51) Int. Cl.[7] ..... F02B 33/04
(52) U.S. Cl. ..... 123/73 PP
(58) Field of Search ..... 123/65 R, 73 PP, 123/73 A, 73 R, 65 P

(56) References Cited

U.S. PATENT DOCUMENTS

| | | | | |
|---|---|---|---|---|
| 4,184,462 A | | 1/1980 | Hale | |
| 5,826,567 A | | 10/1998 | Sakaguchi et al. | |
| 5,881,687 A | | 3/1999 | Sakaguchi et al. | |
| 6,152,093 A | | 11/2000 | Sawada et al. | |
| 6,289,856 B1 | | 9/2001 | Noguchi | |
| 6,491,006 B2 | * | 12/2002 | Jonsson et al. | 123/73 R |
| 2002/0005180 A1 | | 1/2002 | Jonsson et al. | |

FOREIGN PATENT DOCUMENTS

| | | | | |
|---|---|---|---|---|
| EP | 0 933 514 A1 | | 8/1999 | |
| EP | 0 933515 A1 | | 8/1999 | |
| EP | 0 971 110 A1 | | 1/2000 | |
| JP | 2000170538 A | * | 6/2000 | F02B/25/16 |

* cited by examiner

*Primary Examiner*—Tony M. Argenbright
*Assistant Examiner*—Hyder Ali
(74) *Attorney, Agent, or Firm*—Pearne & Gordon LLP

(57) ABSTRACT

An internal combustion engine having a cylinder chamber, a crankcase in fluidic communication with the cylinder chamber, and a scavenging conduit insert providing for the communication between the cylinder chamber and the crankcase. The scavenging insert may form a part of a surface against which a piston slides.

16 Claims, 5 Drawing Sheets

SCAVENGING INSERT FOR AN ENGINE

FIELD OF THE INVENTION

The present invention relates to engines and more particularly, the present invention relates to a scavenging insert for an engine.

BRIEF DISCUSSION OF THE RELATED ART

An internal combustion engine, and a two cycle engine in particular, includes a number of interrelated elements that normally include a cylinder unit, a piston generally housed by the cylinder unit, a crankcase, a crankshaft and a rod that connects the piston to the crankshaft. In a simplified model, the crankcase provides gaseous fuel mixture to the cylinder unit wherein the gaseous fuel mixture is ignited by a spark plug. The ignited mixture creates pressure that acts on the piston, thereby displacing it. As the piston is displaced, the rod affixed thereto similarly is displaced and causes a rotational movement to be imparted on the crankshaft.

As known in the prior art, with reference to FIG. 4, the cylinder unit 200 is provided with a port 204 for the passage of the gaseous fuel mixture from the crankcase to the cylinder unit ignition area 200. Most cylinder units 200 have complex closed wall scavenging conduits with openings at the upper and lower ends. Because of the difficulties inherent in casting and creating a cylinder unit with closed wall scavenging conduits, it would be advantageous if the closed scavenging conduits could be provided by an insert that could be installed after such casting and creating.

SUMMARY OF THE INVENTION

Disclosed according to an example embodiment of the present invention is an internal combustion engine having a cylinder chamber having a cylindrically hollow portion disposed therein; a piston slidably engaged with the cylindrically hollow portion; a crankcase in fluidic communication with the cylinder chamber; and at least one scavenging conduit insert providing for the communication between the cylinder chamber and the crankcase, wherein the scavenging insert provides at least a segment of the cylindrically hollow portion.

Further disclosed according to an example embodiment of the present invention is a piston chamber having at least one scavenging conduit insert, wherein the scavenging conduit insert is circumferentially discontinuous.

Also disclosed according to an example embodiment of the present invention is a scavenging conduit insert for an internal combustion engine, wherein the scavenging conduit insert includes a body portion; a first flange portion engaged with a first end of the body portion; and a second flange portion engaged with a second end of the body portion; wherein the first arm and the second arm are in a spaced apart relationship.

DETAILED DISCUSSION OF AN EXAMPLE EMBODIMENT

Figure 1:
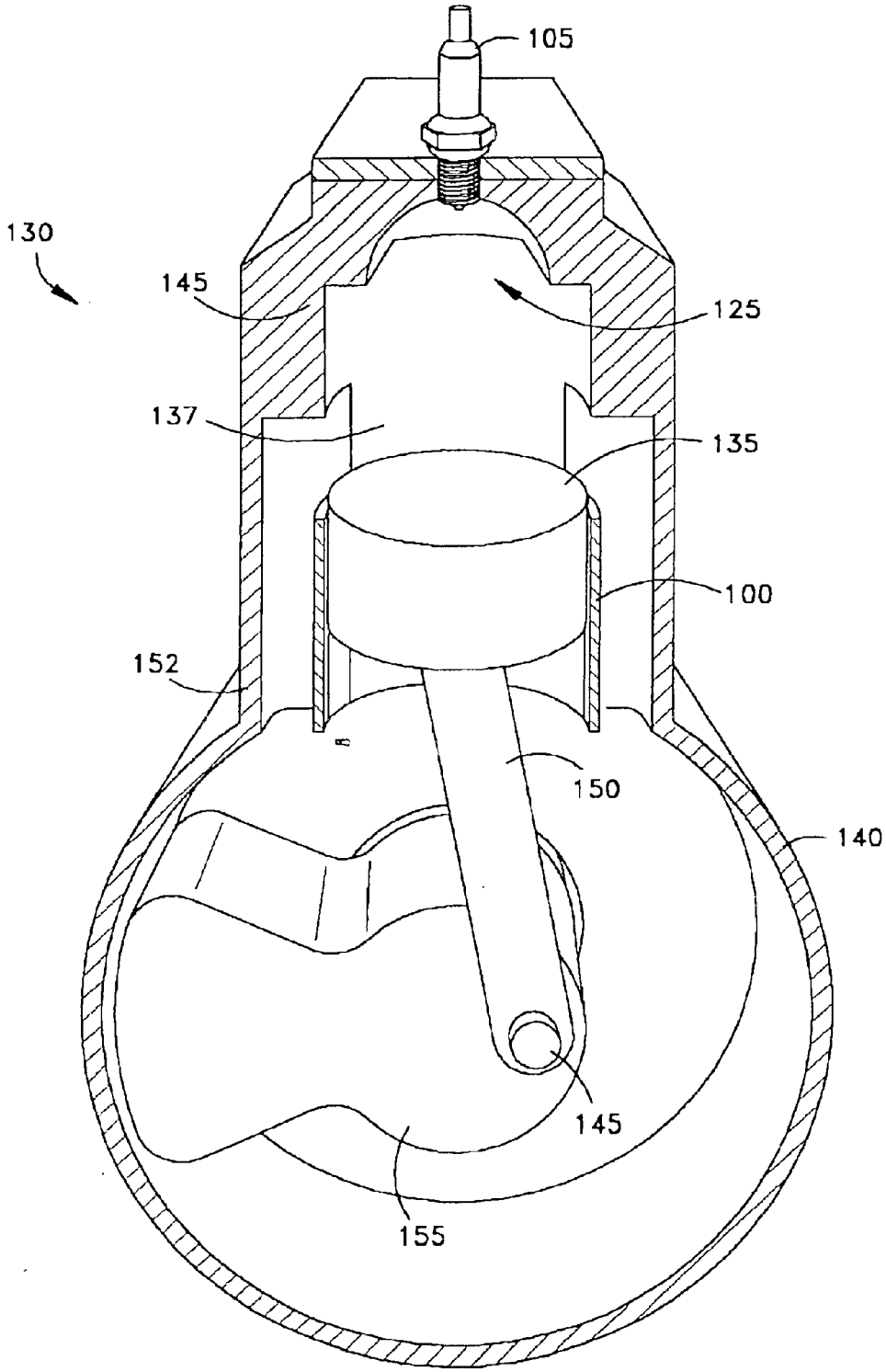
FIG. 1 is an example schematized sectional view of select components of an engine having a scavenging conduit insert, according to the present invention.

With reference to FIG. 1, disclosed according to an example embodiment of the present invention is a scavenging insert 100 for an engine (only schematically shown). It is to be appreciated that two scavenging inserts are shown in the illustrated example of FIG. 1. An example of the engine includes, in relevant part, a cylinder unit 130 in fluidic communication with a crankcase 140; the fluidic communication concept will be more fully discussed herein. The cylinder unit 130 contains a first end 145 and a second end 152 and a generally cylinder bore 137. In an alternative embodiment, the cylinder unit 130 and a top half of crankcase 140 may be a single element.

The cylinder unit 130 is provided with a combustion chamber 125 near or at the first end 145. The combustion chamber 125 provides a location wherein incoming gaseous fuel mixture may be ignited by a sparkplug 105.

The cylinder unit 130 houses a piston 135 that is generally slidably engaged with the cylinder bore 137. The piston 135 is operatively connected with a crankshaft 155 through a connecting rod 150 affixed to the crankshaft 155 by a crank pin 145. The crankshaft 155 is supported by the crankcase 140. As the gaseous fuel mixture is ignited in the combustion chamber 125, the pressure created thereby acts on the piston 135 and forces the piston 135 to slide in the cylinder bore 137 away from the first end 145 of the cylinder unit 130 and toward the second end 152. As the piston 135 so slides, the connecting rod 150 causes the crankshaft 155 to rotate, and thereby provides a rotational force, as will be appreciated by the person of skill in the art.

According to the present invention, the cylinder unit 130 further comprises one or more scavenging conduit inserts 100. With reference to FIG. 1, which discloses an example of the insert, the scavenging conduit insert 100 is a conduit-like member that provides for the fluidic communication between the crankcase 140 and the cylinder unit 130 by permitting the gaseous fuel mixture from the crankcase 140 to flow to the cylinder unit 130. In a simplified model, fuel flows from the crankcase 140, through a port 142 (FIG. 3), defined by the cylinder unit 130 and the scavenging conduit insert 100, to first end 145 of the cylinder unit 130, and then to the combustion chamber 125 of the cylinder unit 130.

Figure 2:
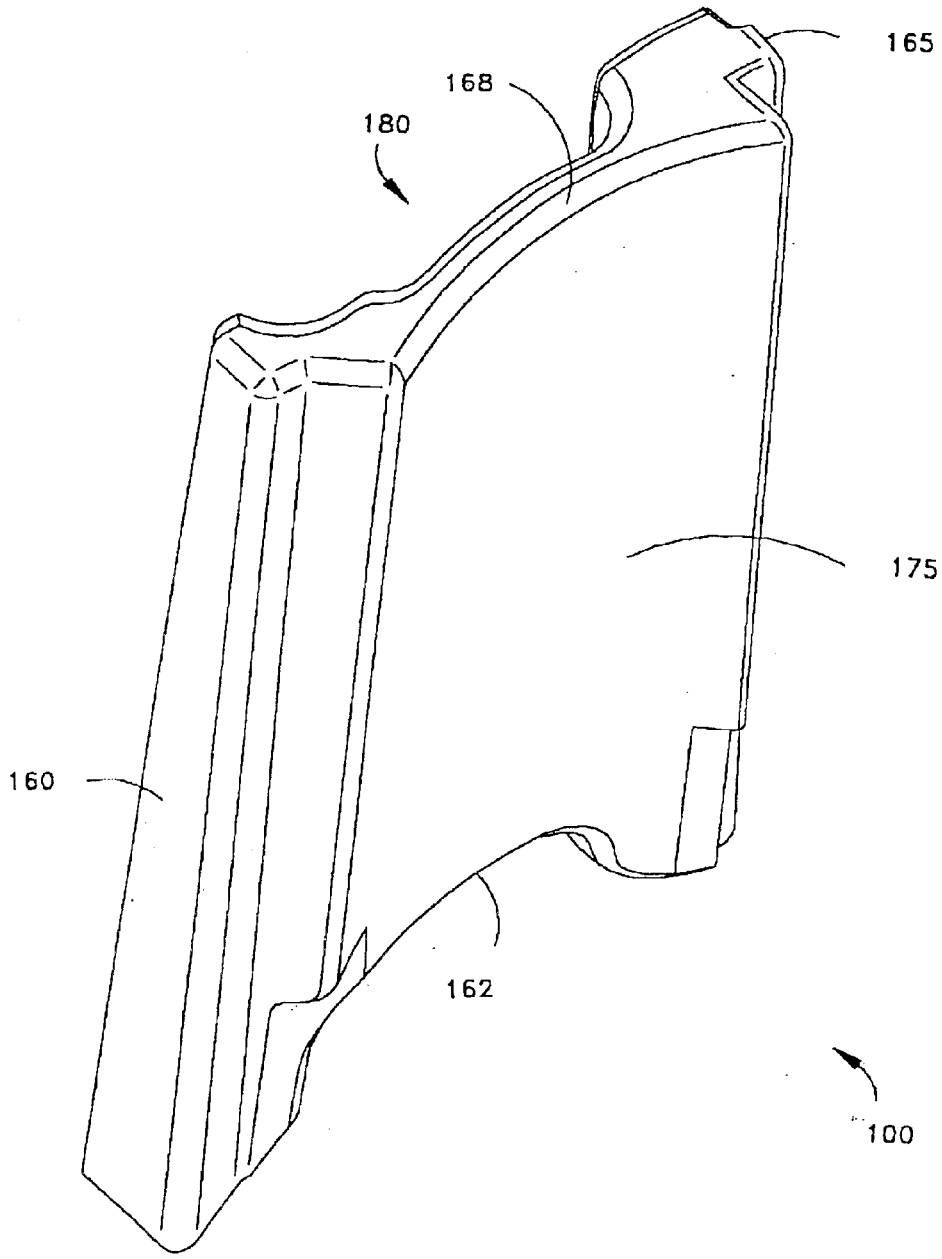
FIG. 2 is an upwardly extending perspective view of an example of the scavenging conduit insert as used in FIG. 1.

An example scavenging conduit insert 100 has a shape as shown in FIGS. 1 and 2 and is generally an elongated and curved unitary panel (i.e., it is a one-piece construction complete in itself) that completes the scavenging port 142. It is positioned in the cylinder unit 130 by an interlocking shape with the surrounding cylinder 130 using, for example, keys and grooves. It may be retained by the installation of other engine parts or fasteners. The scavenging conduit insert 100 is closely positioned to the piston 135 and replaces casting material in the prior art method. The scavenging conduit insert 100 may be fashioned from metal or plastic resin, or any other suitable material known in the art.

The scavenging conduit insert 100 is defined by a body 168, a first flange 160 attached to one side of the body 168, and a second flange 165 attached to another side of the body 168. The scavenging conduit insert 100 is further defined by an outer surface 175 and an inner surface 180. In a preferred example embodiment, the scavenging conduit insert 100 is circumferentially discontinuous. In other words, the insert 100 is provided as a panel, not a cylindrical member. It is to be appreciated, however, that the insert 100 could be provided as a cylindrical member having a continuous circumference.

According to one example, the body 168 may include a curve along the length of its longitudinal axis. The curve is generally circular in shape, with the apex of the curve being arranged on the inner surface 180 of the body 168 between the first flange 160 and the second flange 165.

The first flange 160 is a generally enlarged ridge (relative to the size of the body 168) that proceeds along the longitudinal length of body 168. The second flange 165 is also a generally enlarged ridge (relative to the size of the body 168) that proceeds along the longitudinal length of the body 168. The first flange 160 and the second flange 165 have a shape or are provided with structure complementary to a receiving cavity in the cylinder unit 130 for inserting and securing the insert 100 in the cylinder unit 130.

In the shown example, the first flange 160, second flange 165 and body 168 cooperate to form a recessed portion or aperture 162. When the insert 100 is positioned in the cylinder unit 130, the aperture 162 facilitates the flow of the gaseous fuel mixture by providing an opening through which the gaseous fuel mixture can pass. It is to be appreciated that the insert 100 may be provided without an aperture 162.

Figure 3:
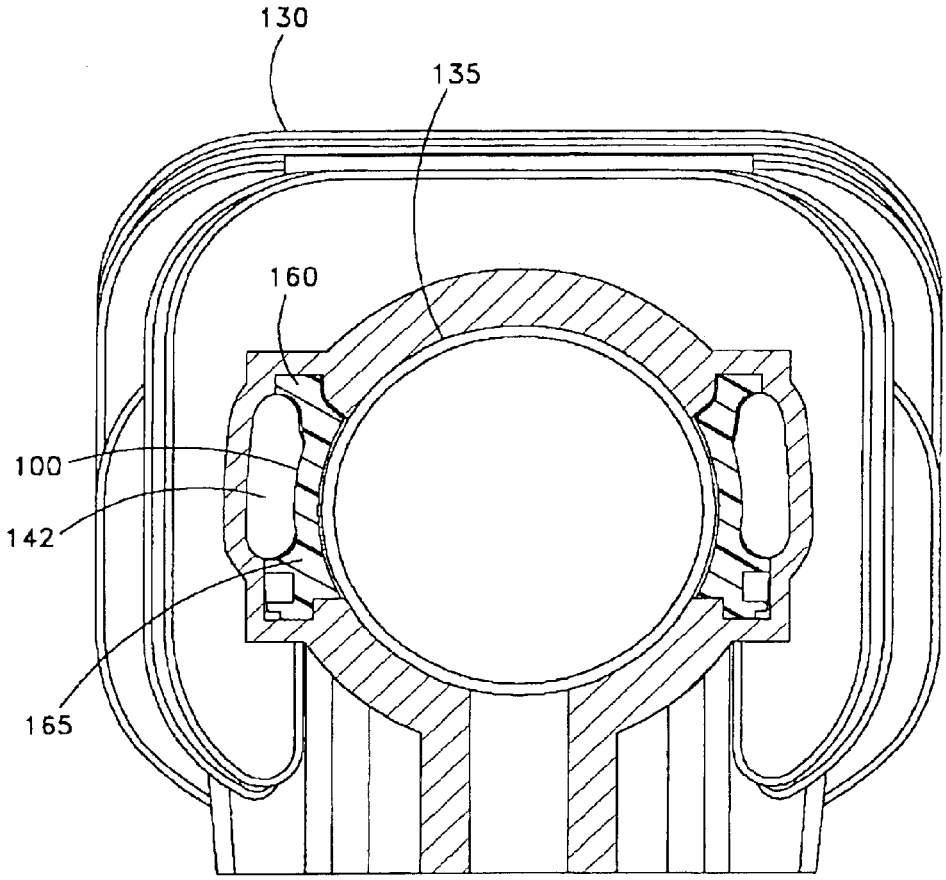
FIG. 3 is a cross sectional view of the engine of FIG. 1 having a scavenging conduit insert.
Figure 4:
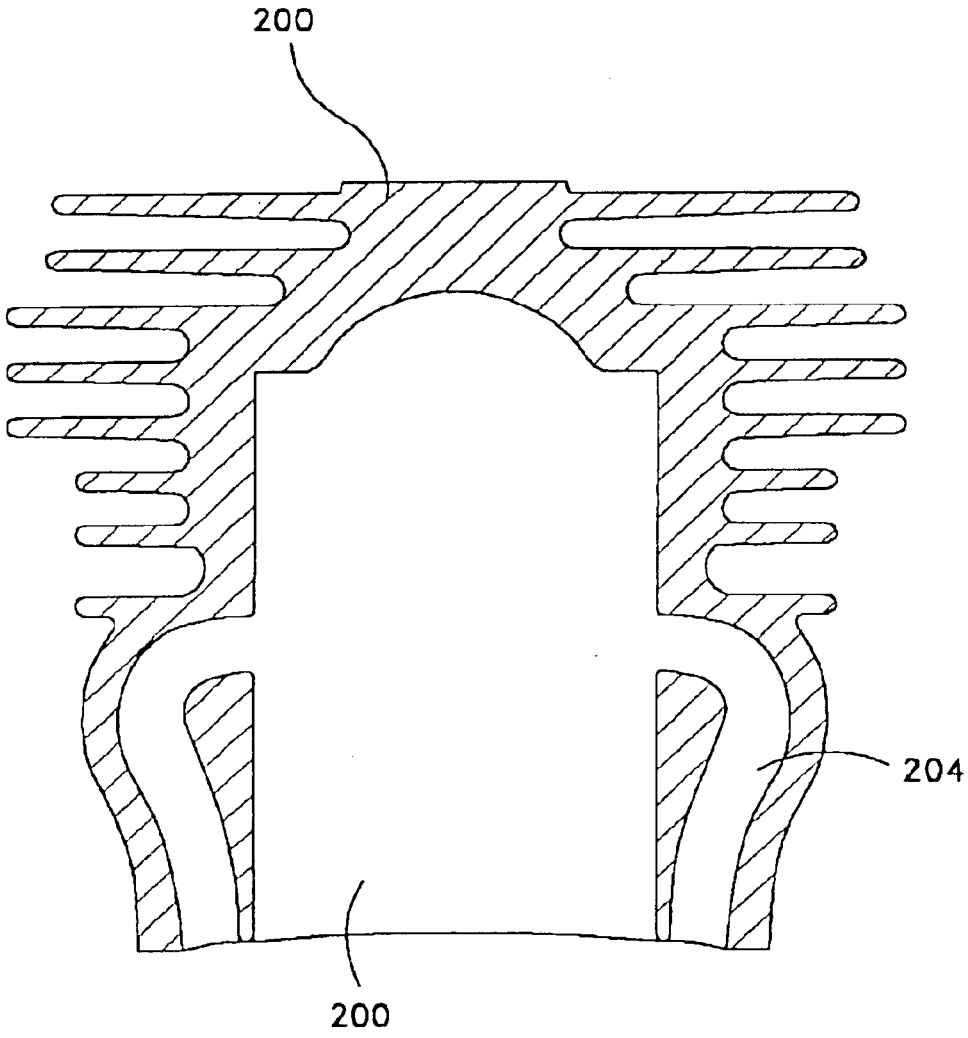
Fig.4 Prior Art
FIG. 4 is an example sectional view of an engine having scavenging ports according to the prior art.

With reference to FIGS. 1 and 3, the cylinder unit 130 is cast or made with structure or cavities capable of receiving one or more scavenging conduit inserts 100. The cavities facilitate the receiving and securing of the inserts 100 and have a shape or are provided with structure complementary to the shape of the inserts 100. In particular, the cavities have a shape or are provided with structure complementary to the shape of the first flange 160 and the second flange 165 to further strengthen the interaction between the inserts 100 and the cavities. According to an example embodiment of the present invention, the cavities are provided near the cylinder bore 137 of the cylinder unit 130 in a position that enables the insert 100 to allow the fluidic communication of the cylinder unit 130 with the crankcase 140.

Because the cavities may be positioned as a part of the cylinder bore 137, it is to be appreciated that the scavenging conduit inserts 100 may form at least a segment of the surface of the cylinder bore 137. Because the piston 135 is slidably engaged with the cylinder bore 137, the inserts 100 could provide at least a segment of the surface against which the piston 135 is slidably engaged.

Figure 5:
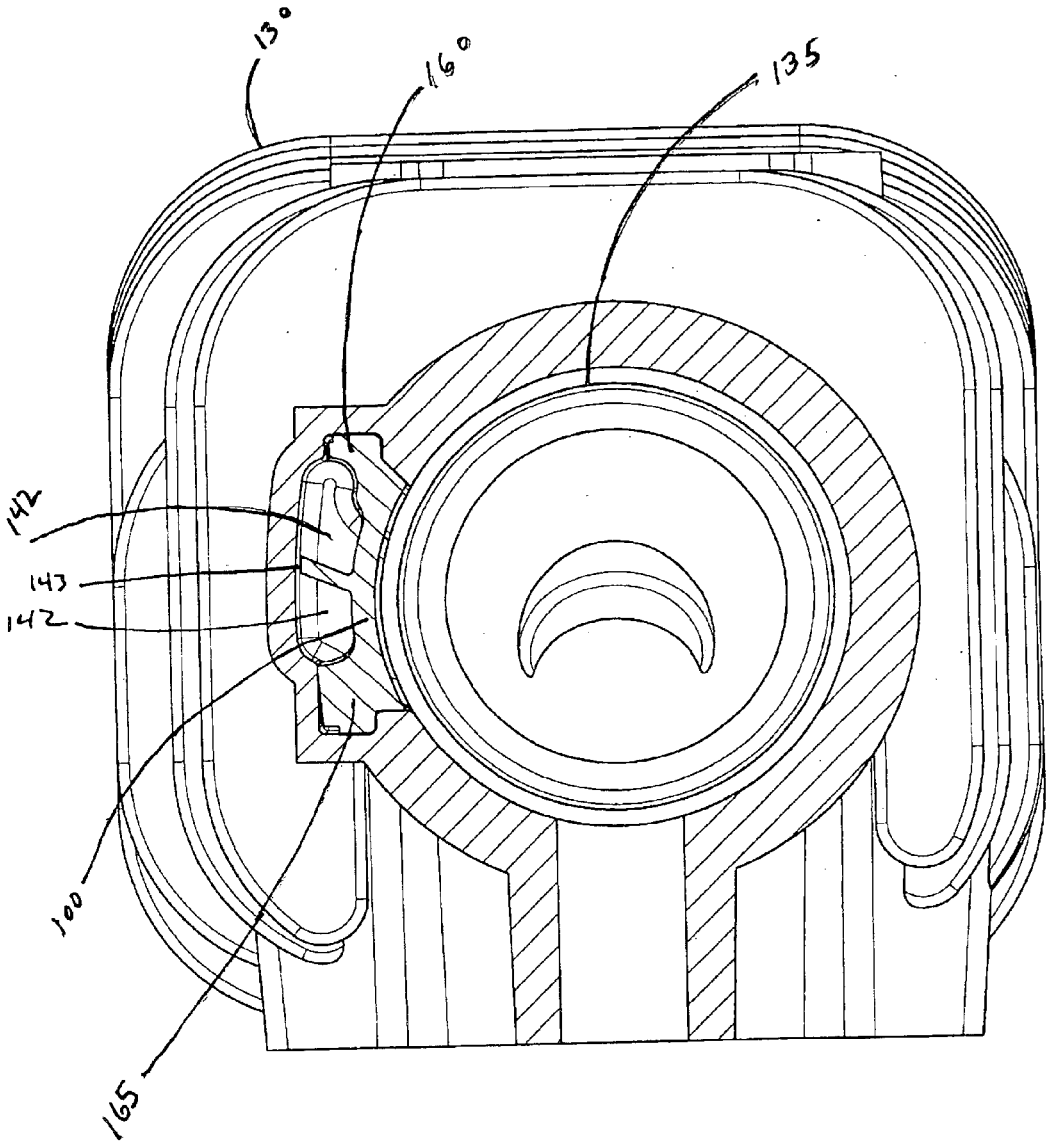
FIG. 5 is a sectional view of the engine of FIG. 1 having a plurality of ports.

The shown example of the insert 100 provides for a single port 142. In other words, the example shows that the insert 100 and the cavity of the cylinder unit 130 cooperate to define a single port 142 through which gaseous fuel mixture can pass. However, it is to be appreciated that the insert 100 and the cavity of the cylinder unit 130 may cooperate to define several ports, i.e., either the port 142 of FIG. 3 may be modified to provide more than one port or the insert 100 may be modified to provide more than one port. For example, with reference to FIG. 5, a projection 143 may be provided to the insert 100 to divide port 142 into two ports. The projection 143 may be any extension or elevation of the insert 100 that proceeds along at least a portion of the longitudinal length of the insert 100. As a further example, the port 142 may be divided into more than two ports, such as three, four, etc., ports. It is to be appreciated that the additional ports can be created by means other than a projection 143, such as any other partitions and/or structures that are sufficient to so create.

It is to be understood that the invention has been described with regard to certain example embodiments. For example, the scavenging conduit insert 100 is applicable to homogeneous scavenged internal combustion engines, stratified scavenged internal combustion engines, etc. It is to be appreciated that certain modifications, changes, adaptations, etc., are contemplated and considered within the scope of the appended claims.

What is claimed is:

1. An internal combustion engine, comprising:

a cylinder chamber having a cylindrically hollow portion disposed therein;

a piston slidably engaged with the cylindrically hollow portion;

a crankcase in fluidic communication with the cylinder chamber;

at least one scavenging conduit insert providing for the communication between the cylinder chamber and the crankcase, wherein the scavenging insert provides at least a segment of the cylindrically hollow portion and wherein the scavenging conduit insert is retained by a main crankshaft bearing.

2. The internal combustion engine of claim 1, wherein the cylindrically hollow portion comprises a surface, and wherein the scavenging insert provides at least a segment of the surface.

3. The internal combustion engine of claim 1, wherein the scavenging insert is circumferentially discontinuous.

4. The internal combustion engine of claim 1, wherein each scavenging conduit insert provides at least one port for the communication between the cylinder chamber and the crankcase.

5. The internal combustion engine of claim 1, wherein the scavenging insert provides at least a segment of the surface against which the piston is slidably engaged.

6. The internal combustion engine of claim 1, wherein the scavenging insert is made of a material different than that of the cylinder chamber.

7. The internal combustion engine of claim 1, wherein the scavenging insert is circumferentially continuous.

8. A scavenging conduit insert for an internal combustion engine, wherein the scavenging conduit insert comprises:

a body portion;

a first flange portion engaged with a first end of the body portion; and a second flange portion engaged with a second end of the body portion, wherein the first arm and the second arm are in a spaced apart relationship and wherein the scavenging conduit insert is retained by a main crankshaft bearing.

9. The scavenging conduit insert of claim 8, wherein the scavenging conduit insert provides at least one port for communication between a cylinder chamber and a crankcase.

10. The scavenging conduit insert of claim 8 further comprising at least one projection extending from the body portion for providing a plurality of ports for communication between a cylinder chamber and a crankcase.

11. The scavenging conduit insert of claim 8, wherein the first flange, second flange, and body portion cooperate to form at least one aperture.

12. A scavenging conduit insert for an internal combustion engine, wherein the scavenging conduit insert comprises:

a body portion;

a first flange portion engaged with a first end of the body portion;

a second flange portion engaged with a second end of the body portion, wherein the first arm and the second arm are in a spaced apart relationship; and at least one projection extending from the body portion for providing a plurality of ports for communication between a cylinder chamber and a crankcase.

13. The scavenging conduit insert of claim 12, wherein the first flange, second flange, and body portion cooperate to form at least one aperture.

14. A method of making a two-stroke engine, the method comprising the steps of:

utilizing a pressure die casting process to make the cylinder chamber of said engine with a scavenging conduit open to the interior space of said cylinder chamber;

inserting at least one scavenging conduit insert between said interior and said scavenging conduit; and retaining said scavenging conduit insert by mating a main crankshaft bearing thereto.

15. The method of claim 14, wherein said engine includes a cylinder chamber having a cylindrically hollow portion disposed therein; a piston slidably engaged with the cylindrically hollow portion; a crankcase in fluidic communication with the cylinder chamber; and said scavenging conduit insert providing for the communication between the cylinder chamber and the crankcase, wherein the scavenging insert provides at least a segment of the cylindrically hollow portion.

16. An internal combustion engine comprising:

a cylinder chamber having a cylindrically hollow portion disposed therein;

a piston slidably engaged with the cylindrically hollow portion;

a crankcase in fluidic communication with the cylinder chamber; and at least one scavenging conduit insert providing for the communication between the cylinder chamber and the crankcase, wherein the scavenging insert provides at least a segment of the cylindrically hollow portion, and the scavenging insert extends to provide a portion of a conduit opening into the cylinder chamber and a portion of a conduit opening into the crankcase.

* * * * *